US011566370B2

(12) United States Patent
Southworth

(10) Patent No.: US 11,566,370 B2
(45) Date of Patent: Jan. 31, 2023

(54) MANUFACTURING PROCESS AND COMPOSITION FOR MULTISPECTRAL CAMOUFLAGE

(71) Applicant: Peerless Adversary LLC, Tuscola, IL (US)

(72) Inventor: Michael Joseph Southworth, Tuscola, IL (US)

(73) Assignee: Peerless Adversary LLC, Tuscola, IL (US)

( * ) Notice: Subject to any disclaimer, the term of this patent is extended or adjusted under 35 U.S.C. 154(b) by 90 days.

(21) Appl. No.: 17/382,791

(22) Filed: Jul. 22, 2021

(65) Prior Publication Data

US 2022/0042240 A1 Feb. 10, 2022

Related U.S. Application Data

(60) Provisional application No. 63/074,064, filed on Sep. 3, 2020, provisional application No. 62/704,430, filed on Aug. 10, 2020.

(51) Int. Cl.
*D06P 1/00* (2006.01)
*D06P 1/673* (2006.01)
(Continued)

(52) U.S. Cl.
CPC ..... *D06P 1/004* (2013.01); *D06M 11/83* (2013.01); *D06M 11/84* (2013.01); *D06M 23/06* (2013.01);
(Continued)

(58) Field of Classification Search
CPC ..... D06P 1/004; D06P 1/0016; D06P 1/0036; D06P 1/46; D06P 1/673; D06P 5/001;
(Continued)

(56) References Cited

U.S. PATENT DOCUMENTS 4,495,239 A * 1/1985 Pusch ..... F41H 3/02 442/232
10,921,095 B1 2/2021 Emery et al.
(Continued)

FOREIGN PATENT DOCUMENTS

JP 5730633 B2 * 3/2011 ..... B32B 27/12
KR 2014/0090178 A * 7/2014 ..... F41H 11/00
(Continued)

OTHER PUBLICATIONS

'Infrared Emissivity Metals', Mastercool, Inc., Dec. 7, 2021 (Dec. 7, 2021, date retrieved) [retrieved from the internet on Dec. 7, 2021 (Oct. 13, 2021) at <https://www.mastercool.com/wp-content/uploads/bsk-pdf-manager/2020/02/emissivity-metals.pdf>].
(Continued)

*Primary Examiner* — Eisa B Elhilo
(74) *Attorney, Agent, or Firm* — Greensfelder, Hemker & Gale, P.C.; Benjamin D. Rotman

(57) ABSTRACT

A process and composition is provided for preparing substrates with both visual and thermal camouflage. The substrate is metallized through a deposition process and polished or calendered to smooth the metal layer and lower the infrared emissivity of the layer deposited onto the substrate. The metallized substrate is then visually decorated by a tarnish and/or dying process that minimally impacts the infrared emissivity of the metallized substrate.

20 Claims, 2 Drawing Sheets

(51) Int. Cl.

| | |
|---|---|
| ***D06P 1/46*** | (2006.01) |
| ***D06M 23/16*** | (2006.01) |
| ***D06P 5/22*** | (2006.01) |
| ***D06M 11/83*** | (2006.01) |
| ***D06M 11/84*** | (2006.01) |
| ***D06M 23/06*** | (2006.01) |
| ***D06P 5/00*** | (2006.01) |

(52) U.S. Cl.
CPC ..... *D06M 23/16* (2013.01); *D06P 1/0016* (2013.01); *D06P 1/0036* (2013.01); *D06P 1/46* (2013.01); *D06P 1/673* (2013.01); *D06P 5/001* (2013.01); *D06P 5/22* (2013.01)

(58) Field of Classification Search
CPC ..... D06P 5/22; D06M 11/83; D06M 11/84; D06M 23/06; D06M 23/16
USPC ..... 8/474
See application file for complete search history.

(56) References Cited

U.S. PATENT DOCUMENTS

2009/0214852 A1 8/2009 Kelsey et al.
2014/0304883 A1 10/2014 Morag et al.

FOREIGN PATENT DOCUMENTS

WO WO 2013/009077 A2 * 1/2013 ..... F41H 3/00
WO WO 2013/054207 A2 * 4/2013 ..... F41H 3/00

OTHER PUBLICATIONS

International Search Report and Written Opinion issued in corresponding foreign application, PCT/US2021/044659, pp. 1-18 (dated Nov. 15, 2021).

* cited by examiner

MANUFACTURING PROCESS AND COMPOSITION FOR MULTISPECTRAL CAMOUFLAGE

CROSS REFERENCE TO RELATED APPLICATIONS

The present application claims priority from U.S. Provisional Patent Application Ser. No. 62/704,430 filed Aug. 10, 2020, and U.S. Provisional Patent Application Ser. No. 63/074,064 filed on Sep. 3, 2020 all of which are incorporated by their entirety.

BACKGROUND OF THE INVENTION

The present invention generally relates to the field of camouflage objects. More particularly, the invention relates to processing objects or textiles in order camouflage the objects or textiles from infrared (IR) detection.

Existing camouflage garments and textiles rely on colors and patterns designed to blend into the surrounding environment to evade detection of the wearer. Dark garments are worn to evade detection in the evening or in darker environments. Patterned garments are worn to evade detection in daytime settings and to blend into more natural environments.

While some systems rely on visual spectrum scanning to detect possible intruders, other systems rely on thermal imaging or IR cameras that receive IR radiation from the surface of a body. These IR cameras typically pick up IR radiation from the skin and project an image comparing the detected radiation compared to the ambient radiation. Night vision systems typically rely on thermal imaging to detect the presence and movement of intruders where it is too dark for detection in the traditional visual spectrum.

IR imaging has its shortcomings with respect to materials with low IR emissivity. Emissivity is a measure of the efficiency in which a surface emits thermal energy. It is defined as the fraction of energy being emitted relative to that emitted by a thermally black surface (a black body). A black body is a material that is a perfect emitter of heat energy and has an emissivity value of 1. A material with an emissivity value of 0 would be considered a perfect thermal mirror. IR imaging also has trouble detecting heat behind smooth or polished metals because they have very low emissivity values. Smooth or polished metals have emissivity values close to zero and will reflect infrared radiation and act as a mirror, while oxidized or anodized metals have emissivity values closer to 1 and will absorb the radiation.

Existing camouflage garments work evade detection in the visual spectrum, however, they are not designed to evade thermal detection because their thermal emissivity for fabrics such as polyester, cotton, and nylon is close to 1. In order to evade thermal detection, the garment must completely cover the body and either be heated or cooled to the ambient temperature of the environment, or the garment must be able to reflect IR radiation back to the thermal imaging device such that it acts as a thermal mirror.

The present invention addresses the current shortcomings of camouflage garments by providing effective camouflage in visible, near infrared, mid infrared, and far infrared simultaneously without changing the fit, form, or function of existing garments.

SUMMARY OF THE INVENTION

In view of the above, a manufacturing process and composition for multispectral camouflage applied to substrate is provided. The process works to metallize objects for the purpose of reflecting IR radiation to evade detection while providing traditional visual camouflage as well. In one aspect of the invention a textile substrate is provided, a metallic layer is deposited onto the textile substrate, the substrate is processed through a calendering or polishing process to smooth out the metallic layer and lower the emissivity of the textile.

In another aspect of invention the metallized substrate is further processed to provide traditional visual camouflage. The process includes selecting silver as the metal for deposition, and tarnishing the metallized substrate to darken or pattern the metallized substrate while maintaining a low emissivity.

In yet another aspect of the invention, the metallized substrate is further processed with an additional camouflage dye layer. In this aspect, an atomized solution comprising a solvent and a water insoluble solvent based acid metal complex dye is sprayed onto the metalized substrate to provide additional visual camouflage patterns without significantly raising the emissivity of the metallized substrate.

In yet another aspect of the invention, the metallized substrate is further processed with an additional camouflage dye layer. In this aspect, an atomized solution comprising a solvent, a binder, and a water insoluble non polar solvent based or metal complex dye is sprayed onto the metalized substrate to provide additional visual camouflage patterns without significantly raising the emissivity of the metallized substrate.

In yet another aspect of the invention an additional protective nanocoating is applied to the metallized substrate to prevent damage to the subsequent layers and maintain thermal camouflage of the metallized textile.

The methods, systems, apparatuses are set forth in part in the description which follows, and in part will be obvious from the description, or can be learned by practice of the methods, apparatuses, and systems. The advantages of the methods, apparatuses, and systems will be realized and attained by means of the elements and combinations particularly pointed out in the appended claims. It is understood that both the foregoing general description and the following detailed description are exemplary and explanatory only and are not restrictive of the methods, apparatuses, and systems, as claimed.

BRIEF DESCRIPTION OF THE DRAWINGS

In the accompanying figures, like elements are identified by like reference numerals among the several preferred embodiments of the present invention.

Other aspects and advantages of the present invention will become apparent upon consideration of the following detailed description, wherein similar structures have similar reference numerals.

DETAILED DESCRIPTION OF THE PREFERRED EMBODIMENTS

Figure 1A:
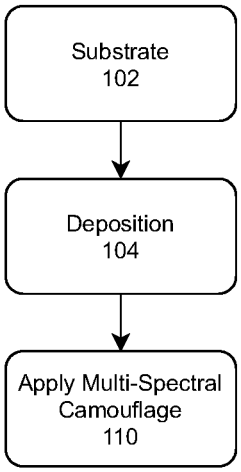
FIGS. 1A-1D are a flow charts representing an examples of the complete multispectral camouflage process flow.
Figure 1B:
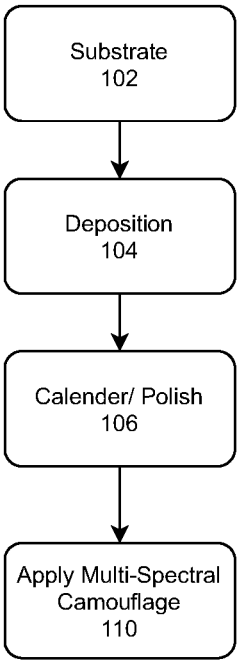
Figure 1C:
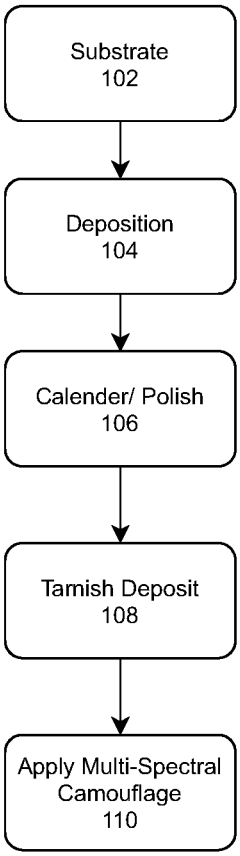
Figure 1D:
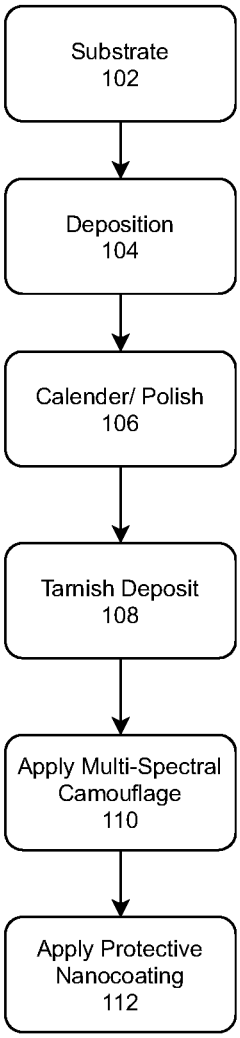

The foregoing and other features and advantages of the invention will become more apparent from the following detailed description of exemplary embodiments, read in conjunction with the accompanying drawings. The detailed description and drawings are merely illustrative of the invention rather than limiting, the scope of the invention being defined by the appended claims and equivalents thereof.

FIGS. 1A-D depict an overview of the overall process and composition preparation of the multispectral camouflage. As shown in FIGS. 1A-D the process 100 includes the steps of acquiring a substrate capable receiving metallic deposition 102, depositing infrared reflective metal with low IR emissivity onto the substrate 104, optionally calendering or polishing the substrate 106, optionally depositing a tarnish layer onto the metal layer 108, applying multispectral camouflage to the metal or tarnish layer 110, and optionally applying a protective coating layer to the multispectral layer/metal/tarnish layer 112.

With respect to the first process step, the substrate may be any material capable of being plated or receiving metallic deposition. For use as camouflage fatigues, the deposition substrate can be a common textiles including but not limited to nylon ripstop, nylon/spandex, Velcro, 500 Denier Cordura, Aramids fibers, cotton, neoprene, or nylon webbing. For use in other objects such as weapon holders, the deposition substrate may be a plastic material.

The deposition step 102 may be performed by any common deposition methods including but not limited to electroless or autocatalytic plating, electroplating, physical vapor deposition (PVD), or chemical vapor deposition (CVD), or even cold or thermal spray deposition. A fine grain deposition having a smooth surface results in a metallized substrate having the lowest IR emissivity. A deposition comprising flake morphology produces a less conductive and less reflective surface having a higher IR emissivity. The darker visual appearance, however, can be used as a "fail safe" camouflage in case the camouflage coating is washed off through a low surface energy solvent. Either grain morphology is effective depending on the desired outcomes of the garment producer, but a smoother grain is preferred to maintain low emissivity and be most effective to reflect IR radiation.

While any infrared reflective metal with low IR emissivity may be deposited onto the substrate, pure polished silver or polished silver with trace amounts of impurities maintains a low IR emissivity between 0.02-0.05. Silver is the most reflective across the electromagnetic spectrum and is typically more cost effective than alternative metals such as Gold. Another benefit of silver is that its tarnish, unlike many alternative metals (such as copper), is mostly infrared transparent allowing the tarnish to be used decoratively as a "fail safe" visual camouflage in the case that the camouflage coating is activated by a low surface energy solvent and removed.

After the initial deposition step 104, the deposition substrate having a metallic layer can be subject to a calendering or polishing step 106. This step may be completed by traditional textile calendering or textile polishing machines. The goal of this step is to smooth the surface of the substrate and refine the grain structure to achieve a greater a more conductive, reflective, and thus a lower IR emissivity surface. It should be noted that other common polishing/smoothing techniques may be used for non-textile substrates.

After the calendering and polishing step 106, in an optional step in order to provide additional visual camouflage, a tarnish deposition step may be processed 108. The tarnish deposition step 108 applies a silver sulfide tarnish layer to the metallized substrate. The tarnish layer provides a dark grey to black color that can be used as backup visual camouflage underneath the multispectral camouflage layer that is later applied. The tarnish serves no purpose other than to act a "fail safe" in case of camouflage activation or a failure of the other multispectral coatings. The silver sulfide tarnish ionically bonds to the silver of the metallized substrate making it difficult to remove in normal use of the camouflage textile. While the tarnish layer provides an additional fail safe camouflage, the tarnish layer may increase the IR emissivity by about 1.5 degrees F. Because of the increase of IR emissivity, for maximum IR camouflage, this step can be skipped.

Figure 2:
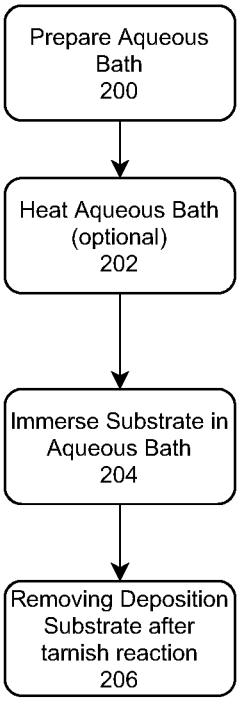
FIG. 2 is a flow chart representing the tarnishing process.

As shown in process flow chart of FIG. 2, the optional tarnish deposition step may include the following steps: preparing an aqueous immersion tank 200, optionally heating the aqueous immersion tank 202, immersing the deposition substrate into the aqueous tank 204, removing the deposition substrate from the immersion tank as the metallized substrate reacts forming the tarnish layer 206. While the reaction will happen in the immersion tank, removing the metallized substrate intermittently helps increase oxygen exposure speeding up the reaction.

The step of preparing the immersion tank 200 may include the mixing water and black salt with a sulfuric content such as Kala Namak Mineral into an immersion tank. In some instances with black salt, the concentration to achieve this may be about 50 grams/liter of water. The optional step of heating the tank to just below boiling point will work to speed up the chemical reaction caused after immersion of the substrate in the next step 204, however, heating may cause the release of harmful sulfuring fumes. Upon immersion of the substrate 204 the silver will react with the sulfur and form a silver sulfide tarnish layer. Upon completion of the chemical reaction, the substrate having a silver sulfide tarnish layer is removed from the immersion tank 206. The end result in the tarnish deposition is typically an increase in IR emissivity is between 1 to 2 degrees F. depending on how much tarnish is applied to the deposition substrate.

It should be recognized by one of skill in the art that the step of depositing a tarnish layer 108 may be achieved in other methods known in the arts using oils or carrier agents as opposed to the immersion tank solution described above. These alternate solutions, however, tend to stain textile fibers of the substrate and thereby further effecting the IR emissivity of the substrate.

Figure 3A:
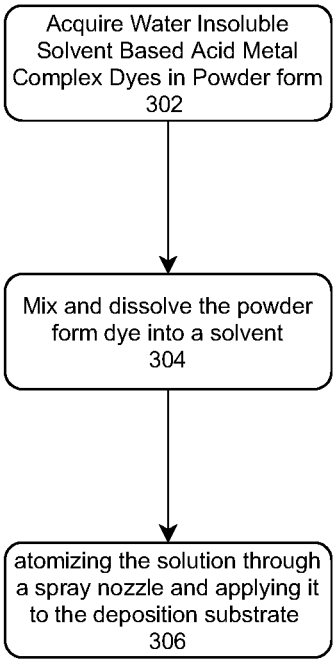
FIG. 3A-3B are flow chart representing the applications of the dye solutions.

After the optional tarnish deposition step 108, the multispectral camouflage solution is applied to the deposition substrate to provide color or visual patterned camouflage to the metallized substrate 110. The multispectral camouflage solution may be formed, as shown in FIG. 3A, by the following steps: acquire water insoluble solvent based acid metal complex dyes in powder form, the dye having a PH level below 7 302, mix and dissolve the powder form dye into a solvent forming a transparent or translucent solution 304, atomizing the solution through a spray nozzle and applying it to the deposition substrate 306.

In this process it is essential the dye be a water insoluble solvent based acidic metal complex dye. The molecules that make up the chromophore of the dye needs to be "acidic" having a negative charge. If the chromophore has a negative charge, the multispectral camouflage solution will be an anionic solution. Upon application onto the silver coated substrate, the anionic solution will produce a chemical reaction with the +1 positively charged silver surface and allow for bonding. Upon the atomization the solvent (acetone) mostly dissolves in air or upon immediate impact to the substrate and deposits the negatively charged dye. The cation silver substrate forms an electrostatic bond with the anion dye molecule and may form a metal to metal covalent bond. A basic dye typically has a positively charge chromophore resulting in an alkaline solution that will not bind to the silver coated substrate (unless a binder is used). With respect to the water insoluble requirement, a water soluble dye after applied, may migrate on the layer with the application of water and pressure, and the water insoluble dye is used to prevent this.

One of skill in the art would recognize alcohol or ketones would work as common solvents. USP grade acetone as it is the purest, tends to dissolve metal complex acidic dyes most effectively leaving little or no residue after contacting the silver substrate layer. The solvent evaporates on contact with the deposition surface almost immediately which allows for fast deposition rates of the solution.

A preferred ratio of dye to acetone is about 10 grams of dye per liter of acetone. As the concentration of dye increases beyond about 10 grams per liter, the color of the solution takes on a darker shade. This is significant because an IR imager will begin to distinguish between an uncoated silver substrate and a coated one. This should be envisioned on a spectrum, but after crossing this threshold it starts to absorb and retransmit IR wavelengths quickly. At the about 10 grams concentration the transparent/translucent dye allows the silver's low emissivity IR waves to transmit through the solution such that an IR imager sees those light waves at a higher concentration than the solution concentration making the difference indistinguishable. The light waves from silver are able to accomplish this due to Snell's law of refraction.

An example formula may comprise approximately:

| INGREDIENT | WT % | WT/g |
|---|---|---|
| Acetone (Solvent) | 99.00 | 1000.00 (1 liter) |
| Water Insoluble solvent based acid metal complex dye (dye) | 1.00 | 10.00 |
| Total | 100.00 | 1010.00 |

Figure 3B:
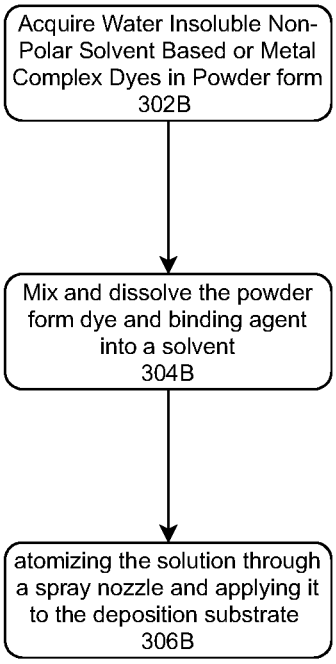

After the solution is prepared, the solution is then atomized and sprayed onto the metalized substrate 306. By spraying with an atomizing nozzle the spray comes out very fine and the acetone or solvent will dissipate and allow the anionic dye particles to attach themselves to the cationic silver substrate. This causes an immediate chemical bonding reaction. The bond is believed to be a metal-metal covalent bond. Because of the covalent bond, the dye solution once applied, does not come off easily through force. The atomizing spray nozzle is preferred as the immersion of the carrier agent (solvent) would not be effective because the dye solution is in a chemically activated state. In some aspects of the process, a mask may applied to the deposition substrate in order to mask off areas and apply multiple dyes or patterns to the deposition substrate. In other variations, at least a second multispectral camouflage solution having a different color or tone than the first multispectral camouflage solution is prepared and a stencil is applied to the deposition substrate. The at least second multispectral camouflage solution is deposited onto the deposition substrate through the stencil In another aspect of the invention, an alternate dye solution and process is contemplated as shown in FIG. 3B. The multispectral camouflage solution may be formed, as shown in FIG. 3B, by the following steps: acquire water insoluble non polar solvent based or metal complex dyes in powder form 302B, mix and dissolve the powder form dye and a binding agent into a solvent forming a transparent or translucent solution 304B, atomizing the solution through a spray nozzle and applying it to the deposition substrate 306B.

In this aspect, the dye solution is formed with a non-acidic, non-polar solvent or metal complex dye. This aspect is for dyes with a PH level over 7 that may have a positive charge. Again, a solvent such as alcohol or acetone is mixed with the dye. Due to the charge being positive it cannot electrostatically bond with the cationic silver substrate and thus a binder is required. Similar to the previous dye solution, the concentration should be about 10 grams per liter of solvent. As the concentration of dye increases beyond about 10 grams per liter, the color of the solution takes on a darker shade. This is significant because an IR imager will begin to distinguish between an uncoated silver substrate and a coated one. This should be envisioned on a spectrum, but after crossing this threshold it starts to absorb and retransmit IR wavelengths quickly. In this variation however, about three percent of the total volume of the solution should further comprise a binder dissolved into the solvent. The binder is used to aid in the dye solution binding to the metalized substrate. Because the dye solution is not anionic, it will not create the metal-metal covalent bond with the metalized substrate as a dye solution using a metal complex acidic dye. In one aspect of this variation, the binding agent may be a pine rosin binder and the solvent may be acetone or the binding agent may be shellac paired with an ethanol solvent. In this aspect, the proportion of rosin to acetone may be about a half pound of rosin per gallon of acetone.

An example formula of this aspect may comprise approximately:

| INGREDIENT | WT % | WT/g |
|---|---|---|
| Acetone (Solvent) | 96.10 | 1000.00 (1 liter) |
| Water Insoluble non polar solvent based or metal complex dye (dye) | 0.96 | 10.00 |
| Rosin (Binder) | 2.88 | 30 (1/2 lb/gal of solvent) |
| Total | 100.00 | 1040.00 |

While the emissivity is similar in both dye solutions, the metal complex acidic dye is preferred because of its binding strength to the metallized substrate.

After the deposition of the multispectral dye solution, a protective nanocoating may be additionally applied to the metallized substrate to prevent wear and tear. A water based nanocoating should be used via spray deposition. In one embodiment, the nanoparticles used are a mixture of functionalized silicon dioxide (SIO2) nanoparticles suspended in an aqueous solution (water). This creates a superhydrophobic coating and somewhat oleophobic coating against oils.

While the step of applying the nanocoating is optional, it helps keep mud off the metallized substrate and it helps protect the colorant from oils and other harsh solvents. From a camouflaging standpoint it serves no purpose.

This should be applied and then rubbed onto the substrate gently. It should then be allowed to cure over a 24-hour period. Additional layers can be applied if desired, but no more than 3 otherwise risk increasing emissivity.

After several washes this nanocoating should be reapplied. If not on a textile it should be reapplied after several uses.

Those of ordinary skill in the art will understand and appreciate the aforementioned description of the invention has been made with reference to certain exemplary embodiments of the invention, which describe a manufacturing process and composition for multispectral camouflage. Those of skill in the art will understand that obvious variations in construction, material, dimensions or properties may be made without departing from the scope of the invention which is intended to be limited only by the claims appended hereto.

The invention claimed is:

1. A method of preparing multispectral camouflaged objects comprising the steps of:

acquiring a deposition substrate;

depositing an infrared reflective metal onto the deposition substrate; and applying a multispectral camouflage layer onto the deposition substrate.

2. The method of preparing multispectral camouflaged objects of claim 1 wherein the deposition substrate is a textile or plastic.

3. The method of preparing multispectral camouflaged objects of claim 2 wherein the infrared reflective metal is a metal with an infrared emissivity under about 0.1.

4. The method of preparing multispectral camouflaged objects of claim 2 wherein the step of depositing the infrared reflective metal includes the step of depositing the infrared reflective metal onto the deposition substrate through any one of the following processes: electroless, autocatalytic plating, electroplating, physical vapor deposition, chemical vapor deposition, or cold or thermal spray deposition.

5. The method of preparing multispectral camouflaged objects of claim 2 wherein the infrared reflective metal is silver.

6. The method of preparing multispectral camouflaged objects of claim 5 wherein after the step of depositing an infrared reflective metal, an additional step of polishing or calendering the deposition substrate is applied to smooth the deposition substrate and lower the infrared emissivity of the deposition substrate.

7. The method of preparing multispectral camouflaged objects of claim 5 wherein after the step of depositing an infrared reflective metal, the additional step of preparing a tarnish layer is applied comprising the steps of:

preparing an immersion tank solution by combining water and black salt into an immersion tank;

immersing the deposition substrate into the immersion tank; and the deposition substrate chemically reacting with the immersion tank solution forming a silver sulfide layer.

8. The method of preparing multispectral camouflaged objects of claim 7 wherein the step of preparing a tarnish layer further includes the step of intermittently removing the deposition substrate from the immersion tank thereby supplying oxygen to the chemical reaction and speeding up the chemical reaction.

9. The method of preparing multispectral camouflaged objects of claim 7 wherein the step of preparing an immersion tank further comprises the step of combining about 50 grams of black salt per liter of water.

10. The method of preparing multispectral camouflaged objects of claim 2 wherein the step of applying a multispectral camouflage layer onto the deposition substrate comprises the steps of:

preparing a first multispectral camouflage solution comprising a solvent and a water insoluble solvent based acid metal complex dye;

atomizing the first multispectral camouflage solution through a spray nozzle; and depositing the first multispectral camouflage solution onto the deposition substrate.

11. The method of preparing multispectral camouflaged objects of claim 10 wherein the solvent is acetone or alcohol and the step of preparing the multispectral camouflage solution comprises combining about 10 grams of water insoluble solvent based acid metal complex dye per about 1 liter of solvent.

12. The method of preparing multispectral camouflaged objects of claim 10 further comprising the steps of applying a mask to the deposition substrate shielding portions of the deposition substrate from the first multispectral camouflage solution.

13. The method of preparing multispectral camouflaged objects of claim 10 further comprising the steps of preparing at least a second multispectral camouflage solution having a different color or tone than the first multispectral camouflage solution, applying a stencil to the deposition substrate, and depositing the at least second multispectral camouflage solution onto the deposition substrate through the stencil.

14. The method of preparing multispectral camouflaged objects of claim 10 further comprising the step of depositing a hydrophobic or oleophobic layer onto the deposition substrate.

15. The method of preparing multispectral camouflaged objects of claim 2 wherein the step of applying a multispectral camouflage layer onto the deposition substrate comprises the steps of:

preparing a first multispectral camouflage solution comprising a solvent, a water insoluble non polar solvent based or metal complex dye, and a binding agent;

atomizing the first multispectral camouflage solution through a spray nozzle; and depositing the first multispectral camouflage solution onto the deposition substrate.

16. The method of preparing multispectral camouflaged objects of claim 15 wherein the solvent is acetone or alcohol and the step of preparing the first multispectral camouflage solution comprises combining about 10 grams of water insoluble non polar solvent based or metal complex dye per about 1 liter of solvent and about 30 grams of binding agent wherein the binding agent is mixed with a ½ lb/gal cut.

17. The method of preparing multispectral camouflaged objects of claim 15 further comprising the steps of preparing at least a second multispectral camouflage solution having a different color or tone than the first multispectral camouflage solution, applying a stencil to the deposition substrate, and depositing the at least second multispectral camouflage solution onto the deposition substrate through the stencil.

18. The method of preparing multispectral camouflaged objects of claim 15 further comprising the step of depositing a hydrophobic or oleophobic layer onto the deposition substrate.

19. The method of preparing multispectral camouflaged objects of claim 10 wherein the water insoluble solvent based acid metal complex dye is negatively charged having a PH of about 7 or under thereby forming an electrostatic bond with the deposition substrate upon deposition.

20. The method of preparing multispectral camouflaged objects of claim 15 wherein the water insoluble non polar solvent based or metal complex dye is positively charged having a PH over 7.

* * * * *